US005810972A

United States Patent [19]

Reinheimer et al.

[11] Patent Number: 5,810,972

[45] Date of Patent: Sep. 22, 1998

[54] METHOD FOR THE PRODUCTION OF CREPED HYGIENIC CELLULOSE PAPER

[75] Inventors: Horst Reinheimer, Kelkheim; Frank Rehders, Pinzberg, both of Germany

[73] Assignee: The Procter & Gamble Company, Cincinnati, Ohio

[21] Appl. No.: 716,172

[22] PCT Filed: Mar. 14, 1995

[86] PCT No.: PCT/EP95/00933

§ 371 Date: Feb. 14, 1997

§ 102(e) Date: Feb. 14, 1997

[87] PCT Pub. No.: WO95/25847

PCT Pub. Date: Sep. 28, 1995

[30] Foreign Application Priority Data

Mar. 18, 1994 [DE] Germany ..... 44 09 372.1

[51] Int. Cl.[6] ..... D21H 15/04; D21H 17/24

[52] U.S. Cl. ..... 162/175; 162/111; 162/112; 162/142; 162/163; 162/176

[58] Field of Search ..... 162/111, 112, 162/135, 141, 142, 148, 158, 175, 168.1, 178, 163, 14, 11, 177, 176

[56] References Cited

U.S. PATENT DOCUMENTS

| | | | |
|---|---|---|---|
| 3,138,473 | 6/1964 | Floyd et al. | 106/205 |
| 4,071,651 | 1/1978 | Hicklin et al. | 428/284 |
| 4,758,282 | 7/1988 | Stober et al. | 127/34 |
| 4,940,513 | 7/1990 | Spendel | 162/112 |
| 4,940,784 | 7/1990 | Stober et al. | 536/1.1 |
| 5,338,406 | 8/1994 | Smith | 162/168.2 |
| 5,338,407 | 8/1994 | Dasgupta | 162/168.2 |
| 5,415,736 | 5/1995 | Grether | 162/111 |
| 5,554,745 | 9/1996 | Chiu et al. | 536/52 |
| 5,690,790 | 11/1997 | Headlam et al. | 162/175 |

OTHER PUBLICATIONS

Smook, G.A., Handbook of Pulp & Paper Terminology, Angus Wilde Publications, pp. 137–138, 1990.

Smook, G.A. "Handbook for Pulp & Paper Technologists," 1982, pp. 5–7, pp. 202–207.

Oliver, J.F.; "Dry Creping of Tissue Paper, A Review of Basic Factors" Tappi, vol. 63, No. 12, Dec. 1980; p. 92.

*Primary Examiner*—Peter Chin

*Attorney, Agent, or Firm*—Julia A. Glazer; Larry L. Huston; T. David Reed

[57] ABSTRACT

A method for the manufacture of creped hygienic cellulose paper, in particular. A hemicellulose containing additive, in particular galactomannan, xylan or highly milled birch pulp, is added to the pulp either prior to the pulp being deposited on the wire of the paper machine, after the pulp is deposited on the wire of the paper machine, or both before and after the pulp is deposited on the wire. As a result of this measure, the strength of the paper web thus produced and its runnability properties are substantially improved, while the softness virtually remains unchanged. In addition, the energy requirements for drying the paper web are substantially reduced.

15 Claims, No Drawings

METHOD FOR THE PRODUCTION OF CREPED HYGIENIC CELLULOSE PAPER

TECHNICAL FIELD

The invention relates to a method for the production of creped hygienic cellulose paper, and in particular of tissue paper, comprising a method for manufacturing creped hygienic cellulose paper, in particular tissue paper wherein the method comprises the steps of: producing a cellulose containing pulp; depositing a wet pulp web on a continuously rotating wire; draining the wet pulp web on the wire; primary draining of the wet pulp web by means of pressing rollers; transferring the wet web to a yankee drier; and scraping the dried paper web off the yankee drier while creping the web.

Accordingly, the invention proceeds from the conventional production methods for creped hygienic cellulose papers that have a grammage of 14 to 22 g/m as a rule.

BACKGROUND OF THE INVENTION

Conventionally, a cellulose containing pulp is made for the production of creped hygienic cellulose paper, which is deposited in the form of a wet pulp web on a continuously rotating wire, which usually is an endless wire of water-permeable fabric deflected via rolls and driven thereby. During the transport of the wet pulp web on the advanced wire, the wet web is preliminarily drained by part of the water contained therein flowing off through the wire. Then the main draining of the wet pulp web takes place by means of pressing rollers, after which the web has a solids content of 40 to 50%. The pressing rollers may for instance be arranged in the vicinity of the yankee drier or delivery felt mentioned below.

During or after the main draining, the wet web is for instance transferred by means of a so-called delivery felt to a rotating drying cylinder, which may be a so-called "yankee drier". The yankee drier is heated from inside by high pressure steam (for instance of 8 bar). Further, a drying hood, if necessary two-parted in the direction of rotation, is disposed over the width of the yankee drier and about half its circumferential length; hot air (of a temperature of 250° C. to 450° C.) is blown via the drying hood from outside on the wet web. As a result of the above measures, the wet pulp web dries while rotating about the yankee drier, adhering to the latter. The desired solids content of the paper web dried on the yankee drier is 94 to 96%.

Finally, the dried paper web adhering to the yankee drier is detached from the yankee drier by a scraper knife extending over the width of the cylinder and is simultaneously creped. The detached paper web is rolled on to reels—which operation may be accompanied by defined stretching, if required.

The method outlined above comprises the basic steps for the production of cellulose paper, however, within the frame of papermaking knowhow, individual steps may be modified or completed. The invention can be used in such modified processes too.

The invention proceeds from different problems posed by the production of creped hygienic cellulose papers:

in regards to the product properties of the tissue paper, there is the requirement of as high as possible a strength on the one hand, but also of the highest possible softness in view of the field of application of hygienic papers. Fundamentally, these two requirements are contradictory, because an especially strong paper will as a rule be comparatively hard and an especially soft paper will as a rule not be very strong. Proceeding from a certain kind of cellulose for the manufacture of paper, in particular measures taken to increase the strength, for instance by the addition of corresponding additives, will result in a decrease of the paper softness. For the manufacture of paper, therefore, a compromise must be found between the two mentioned requirements.

In paper manufacture, special attention must be directed to the machine running properties of the paper web—the so-called runnability. These are different properties, such as the uniform structure of the paper web, the degree and the uniformity of its adherence to the yankee drier, the possibility of scraping the paper web off the yankee drier etc.

The formation of a layer—the so-called coating film—on the yankee drier is, among other things, of decisive importance for the runnability of the paper web; as a principle, this layer develops from such constituents of the paper web as emerge therefrom. The formation of the coating film can virtually not be detected by objective parameters. Its quality is judged by the operator's experience in paper making.

For supporting the forming of the coating film and its quality as well as for adjusting the adherence of the paper web to the yankee drier, corresponding reagents (so-called release agents or adhesives) can be sprayed on the yankee drier, which in the first place support the detachability or adhesion characteristics of the dried paper web towards the yankee drier.

In addition to the raw material cost, a substantial criterion for the costs of paper manufacture resides in the energy costs of running the paper machine. The latter strongly depend on the temperatures needed on the yankee drier for drying the paper web. This means that a paper web, which has an increased solids content after the preliminary and main drainage, can be set to the desired solids content after drying by lower steam temperatures and pressures on the yankee drier and a lower air temperature in the drying hood, which goes along with considerable energy saving.

It is accordingly an object of the invention to improve the method of the generic kind such that, at a reduced demand for energy but at runnability properties ranging from satisfying to excellent, hygienic cellulose papers can be produced, exhibiting clearly increased strength characteristics and a softness that is virtually not, or only insignificantly, reduced.

SUMMARY OF THE INVENTION

This invention which relates to a method for the manufacture of creped hygienic cellulose paper, in particular tissue paper, comprises the steps of:

a) producing a cellulose containing pulp;

b) depositing a wet pulp on a continuously rotating wire so as to form a wet pulp web;

c) preliminarily draining the wet pulp on the wire;

d) pressing the wet pulp web whereby;

e) transferring the wet pulp web to a yankee drier;

f) drying the wet pulp web on the yankee drier; and g) scraping the dried paper web off the yankee drier while creping the web.

A hemicellulose containing additive is added to the pulp either prior to depositing the wet pulp on the wire, after depositing the wet pulp on the wire, or both before depositing and after depositing the wet pulp on the wire. Hemicellulose containing additives which may be added include galactomannan, xylan, birch pulp, or mixtures thereof.

DETAILED DESCRIPTION OF THE INVENTION

The nub of the invention resides in the addition of hemicellulose containing additives to the pulp prior to the deposit of the wet pulp web on the wire, or to the wet web itself.

In this context it must be explained that in addition to the celluloses, hemicelluloses are important structural constituents of tissue fibers. The connection between the distribution of the hemicelluloses as well as the average degree of polymerization of the celluloses in the fiber walls and the mechanical properties of strength of celluloses and of papers made therefrom had been realized and examined (cf. publication in "Das Papier", volume 10A, 1993, pages V30 to V40, of K. Bachner et al.: "Zusammenhang zwischen Aufbau der Zellwand und Festigkeitseigenschaften bei Faserstoffen von konventionellen und neuen Aufschlußverfahren"). This publication substantially teaches that high strength values of the celluloses are reached by new pulping processes for celluloses—the so-called ASAM Method and the Organocell Method are cited by way of example—as a result of the distribution of the hemicellulose determined therein. The studies, on which the above publication is based, belong to the basic research in the field of paper making. This publication does not give any aspects of putting the knowledge on the problems mentioned at the outset into practice in order to improve the method of manufacturing creped hygienic cellulose papers.

Further, the effect of xylan, which is a hemicellulose containing substance isolated from corn cobs, on the properties, in terms of paper making technology, of laboratory test sheets of printing paper and wrapping paper was examined in the past (cf. publication in the Czech magazine "papir a celulóza", 41, (7–9) 1986, pages V23 to V30, of Anna Náterová et al., "Einsatz von Xylan bei der Papierherstellung"). During the manufacture of wrapping paper with the content of 50% of short fiber material the flexural strength is quoted to increase by 172% after the addition of 2% xylan. The same addition of xylan improved the IGT linking strength of a printing paper and prevented the two-sided effect.

Tests in the manufacture of creped hygienic cellulose paper by the method according to the invention, details of which will become apparent from the ensuing examples of embodiment, have shown that the addition of hemicellulose containing additives gives substantial and surprising advantages:

- Given only minor decreases in the softness of the hygienic tissue paper, increases in rupture strength ranging from 15 to 73% can be observed in the machine direction, and ranging from 17 to 90% in the cross direction.
- The drainability of the wet web rises by the addition of hemicellulose containing additives such that the yankee drier pressure can be reduced by as much as 25% and the air temperature used in the drying hood by as much as 40%.
- The runnability and coating film properties of the paper web, which cannot be characterized by objective parameters, are considerably improved.

Hemicellulose containing additives can be added during the manufacture of the pulp in the pulper—i.e. for instance in the machine vat—which goes along with an especially good mixing of the additives and the pulp. By alternative, if the additives are added during the supply of the pulp to the wire, they can virtually be added in situ prior to the material accumulation on the wire. Furtheron, it is possible to add the additives to the refining pulper directly after the refining treatment of the cellulose raw material.

Fundamentally, attention must be drawn to the fact that the hemicellulose containing additives can be admixed to the cellulose already during the production of the raw material for the tissue paper manufacture—i.e. during the manufacture of the corresponding cellulose.

Preferred hemicellulose containing additives are galactomannan, birch pulp, and xylan. The galactomannan powder may either be unmodified (i.e.; nonionic) or cationic. Mixtures of unmodified and cationic galactomannan powders may also be used. The galactomannan powder is mixed with water to form a solution of the galactomannan powder in water. Suitable concentrations of the galactomannan powder in water range from about 1% to 10%. The solution of galactomannan powder is added to the pulp and/or the wet web at a concentration of from about 0.15% to 1.5% based on the dry weight of the cellulose fibers. The preferred birch sulfate pulp will have a Schopper-Riegler slowness value of at least about SR°80. Based on dry weight, birch sulfite pulp can be added to the pulp and or the wet web at a concentration of from about 1 to 6% of the dry weight of the cellulose fibers.

Prior to adding the hemicellulose containing additive of this invention to the pulp, it is preferable that the pH of the pulp be in the range of about 8.0 to 8.5. After addition and mixture of the hemicellulose with the pulp it is preferred that the pH of the hemicellulose/pulp blend be adjusted to a pH range of from about 6.5 to 7.0. Optionally, a wet strength agent may also be added to the pulp. Its addition taking place in the alkaline aqueous medium ensures the solubility of the hemicelluloses.

As a result of the subsequent neutralisation and the addition of a cationic fixative, the hemicelluloses are attached to, or respectively, coagulated on the cellulose fibers so that the positive properties of these additives may fully develop.

Further features, details and advantages of the method according to the invention will become apparent from the ensuing description of exemplary embodiments of the invention on the basis of tests that have been made.

Fundamentally, a so-called crescent former of the company of VALE, Sweden, was used as a paper machine for performing the tests; this machine comprises a multilayer feed unit, two pressing rollers, a spraying bar for applying coating film producers, and allows paper reel widths of 570 mm, given a machine width of 600 mm.

Eucalyptus sulfite cellulose of the company of CAIMA and long fiber sulfite cellulose of MODO were used as the raw material for the manufacture of the paper web. The long fiber sulfite cellulose had a Schopper-Riegler slowness value of SR°20 to 22. By contrast, the eucalyptus sulfite cellulose was only deflaked. Owing to the multilayer feed unit, the raw materials were supplied to the machine in such a way that ⅔ of eucalyptus sulfite cellulose were placed on the side of the cylinder and ⅓ of long fiber sulfite cellulose was placed on the side of the hood. A paper web gsm substance of 16 g/m$^2$ was chosen for the tests. The running rate of the paper web through the machine was 1,200 m/min. The linear force of pressure of the two pressing rollers was 90 kN/m or 80 kN/m, respectively. The desired solids content after the final drying at the output of the cylinder was fixed to be 95% and the degree of creping was fixed to be 16%.

The wire of the machine was a single-layer fabric of the company of ALBANY/Nordiskafilt. The delivery felt is of the "Albany Duravent" type. Cationic galactomannan, unmodified (nonionic) galactomannan, xylan without side chains (derived from the production of viscose) and highly milled ECF birch sulfate pulp having a slowness value of SR°80 were used as hemicellulose containing additives. The product "Catiofast CS" of the BASF company was used as cationic fixative and "Giluton 501 N" as a wet-strength agent.

The following production tests were carried out on the basis of the method according to the invention. The results can be taken from the table "Test Results" attached to the ensuing description:

Test No. 0

This test served for preparing a reference sample, in which the standard cellulose mixture specified above with the addition of 5 kg/t Giluton 501 N as wet-strength agent was processed into a tissue sample without hemicellulose being added. The furnish of cellulose and the concentration of the wet-strength agent were maintained during the susequent tests, in which hemicellulose containing additives were admixed.

As a rule, several test passes were made under otherwise unchanged conditions and the measured values were determined by averaging the individual test results.

Test no. 0 gave a tissue paper exhibiting, in a four-layer arrangement, a rupture strength of 16.97N/50 mm in the machine direction (MD) and of 8.5N/50 mm in the cross direction (CD). The cylinder pressure was 600 kPa, the hood temperatures amounted to 371° and 377° C., respectively.

The machine run was in order. The tissue sample was very soft, but of very little strength.

Test Series No. 1

A cationic galactomannan was used as a hemicellulose containing additive. For admixing the cationic galactomannan to the pulp, cationic galactomannan powder was dissolved in water to give a 10% solution. This solution was added to the pulp, with the portions of galactomannan changing.

Test No. 1a

The solution specified above with a dry weight percentage of 0.2% of galactomannan powder referred to the dry weight of the pulp fibers was pumped into both pulp supply lines for the multilayer feed unit.

As regards the runnability properties, a release effect occurred as a result, i.e. the adhesion of the paper web to the cylinder decreased. Further, the coating film slightly deteriorated. However, the paper web was easier to dry and its rupture strength (dry) increased by about 15% (MD) and 17% (CD).

Test No. 1b

The above-specified galactomannan solution was added, having a constituent amount of 0.4% of galactomannan powder referred to the dry weight of the cellulose fibers, and corresponding tissue paper webs were produced in a several machine runs.

As a result, the observed release effect persisted. However, the drying was even more facilitated, which meant a further reduction of the cylinder pressure and further decreased hood temperatures. The rupture strength (dry) grew by an average of 44% (MD and CD).

Test No. 1c

The above-specified galactomannan solution was directly supplied to the pulper in a weight percentage of 1.0%.

The result was a further facilitation of the drying, which continuously improves as the concentration of cationic galactomannan rises. The decrease of the hood temperature reached its maximum, the decrease of the cylinder pressure reached its next to highest value. The rupture strength (dry) grew by an average of 84% (MD) and 90% (CD).

Test Series No. 2

In this series of tests, highly-milled birch pulp was used as a hemicellulose containing additive. Birch pulp was milled in the usual way, until a slowness value of SR°80 had been reached. Such a birch pulp is of wet, slimy consistence. So as to achieve a good solution of the hemicelluloses in the base pulp mentioned at the outset on the one hand, and on the other, the fixing of these hemicelluloses to the cellulose fibers, the base pulp was set to a pH value of 8 to 8.5 by means of sodium hydroxide. Then the highly milled birch pulp as well as the cationic fixative "Catiofast" for the fixing of the hemicelluloses mentioned above were added. Subsequently, the pulp nix obtained was set to a pH of 6.5 to 7.0 by means of sulfuric acid.

Test No. 2a

In the manner specified above, highly milled birch pulp with a weight percentage of 2% referred to the dry weight of the cellulose fibers of the base pulp was added to the latter.

As a result, excellent runnability properties were achieved, a strong, uniform coating film forming rapidly upon the start of the paper machine. Sheet making was equally good. The rupture strength (dry) grew by an average of 24% (MD) and 26% (CD).

The tissue paper obtained in this test was however slightly harder than the reference sample.

Test No. 2b

As specified above, highly milled birch cellulose with a solid content of 5% referred to the dry weight of the cellulose fibers was added to the base pulp.

This resulted in excellent runnability properties and in the formation of a coating film of extraordinary quality. The rupture strength (dry) grew by an average of 56% (MD) and 40% (CD).

Test Series No. 3

In this case, unmodified galactomannan in the form of a 1% solution in water was used as a hemicellulose containing additive. This solution was placed into the pulper for the galactomannan to dissolve more easily. A propeller disposed on the bottom of the pulper was used to improve the mixing. Together with the pulp, the unmodified galactomannan was stirred for at least 20 minutes. Then the cationic fixative "Catiofast" was added and the pH was set to 6.5 to 7.0 with the aid of sulfuric acid.

Test No. 3a

The above-mentioned solution of unmodified galactomannan with a dry weight percentage of 0.4% galactomannan related to the dry weight of the cellulose fiber of the base pulp was added to the latter.

As a result, the softness of the tissue made thereof had clearly improved as compared to the birch test. Good coating film and sheet forming could be observed. The rupture strength increased by an average of 52% (MD) and 32% (CD). Owing to the addition of unmodified galactomannan, a decrease of the cylinder pressure and of the hood temperature was possible, resulting in the same desired solids content of the dried paper web of 95%.

Test No. 3b

The 10% solution of unmodified galactomannan with a solids content of 1% of galactomannan referred to the dry weight of the cellulose fibers in the base pulp was added.

As a result, a uniform, good coating film was observed, which was only a bit thinner as compared to the birch test. Sheet forming, softness and runnability were good. As compared to Test no. 3a, the paper web dried slightly better, i.e. the increased concentration of the galactomannan resulted in a further decrease of the pressure and the hood temperature. The rupture strength (dry) grew by an average of 54% (MD) and 22% (CD).

Test No. 3c

In addition to the admixture of 1% of unmodified galactomannan effected by analogy to Test no. 3b, cationic galactomannan according to Test Series no. 1 having a solids content of 1% of cationic galactomannan related to the dry weight of the cellulose fibers in the base pulp was directly placed in the pulper.

As a result, the adhesion of the paper web to the yankee drier was slightly lower than in the preceding test of Test Series no. 3. However, the creping was good and the tissue product was soft. The rupture strength grew by an average of 62% (MD) and 37% (CD). The combination of the cationic and the unmodified galactomannan as hemicellulose containing additives allowed a maximal decrease of the cylinder pressure and a strong decrease of the hood temperature.

Test No. 3d 0.4% of unmodified galactomannan and 1% of cationic galactomannan, in each case referred to the dry weight of the cellulose fibers in the base pulp, were admixed as hemicellulose containing additives. Otherwise, the procedure was the same as in Test no. 3c.

As a result, a better coating film was found on the cylinder. The rupture strength (dry) grew by an average of 58% (MD) and 39% (CD).

Test Series No. 4

Xylan without side chains occasioned as a by-product in the manufacture of viscose was used as a hemicellulose containing additive. The xylan was dissolved by strong stirring in a 30° C. solution of sodium hydroxide and water with a pH of 10 to 11. A 2% solution was prepared. Then a defined quantity of this xylan solution was pumped into the base pulp set to a pH of 8.5, which was followed by strong stirring. For fixing the xylan to the cellulose fibers, 10 l/t of the cationic fixative "Catiofast" were added, subsequent to which the pH of the pulp was set to 6.5 to 7.0 by means of sulfuric acid for ensuring the xylan fixing.

Test No. 4a

In the manner mentioned above, xylan solution in a quantity of 0.2% by weight of solid xylan referred to the dry weight of the cellulose fibers in the base pulp was added.

The result was the forming of a thin, streaked coating film. The runnability properties of the paper web were in order. The cylinder pressure was lowered by about 8% as compared to Reference Test no. 0, the hood temperature was lowered distinctly by about 30%. The tissue product obtained was soft, giving a pleasant tactile feeling.

The rupture strength (dry) increased by an average 73% (MD) and 44% (CD).

Test No. 4b

Xylan solution in a dry weight quantity of 0.4% xylan referred to the weight of the cellulose fibers in the base pulp was added in the manner mentioned above.

As a result, the formation of the coating film was improved, the coating film however still being streaked, and the runnability properties were in order. The product was comparatively soft. The rupture strength (dry) grew by an average of 52% (MD) and 33% (CD). The cylinder pressure and the hood temperature were even further lowered as compared to Test no. 4a.

Test No. 4c

By analogy to Test no. 4b, xylan in a dry weight quantity of 1% referred to the dry fiber weight was added to the base pulp.

As a result, the forming of the coating film and the runnability improved. The product was even softer. The rupture strength (dry) increased by an average of 40% (MD) and 31% (CD). As compared to Test no. 4b, the cylinder pressure and hood temperatures were almost constant.

The above quantitative data on the strength and the softness of the tissue paper prepared in the individual tests as well as the accompanying conditions of cylinder pressure and the hood temperature can be taken from the ensuing table "Test Results".

The individual columns of the table have the following meaning:

"Test"=test no. as used above

"FG"=grammage of the paper web prepared in g/m$^2$

"Average MD"=average rupture strength (dry) of a 4-layer tissue sample related to the machine direction in N/50 mm "Average CD"=average rupture strength (dry) of a 4-layer tissue sample referred to the cross direction of the paper web in N/50 mm "Increase (toward 0) MD %"=increase of the average rupture strength as compared to the reference sample related to the machine direction "Increase (toward 0) CD %"=increase of the average rupture strength as compared to the reference sample related to the cross direction "Strength Index"=$\sqrt{MD \times CD}$ in N/50 mm "Softness"=rating number, established from a panel test, for the softness of the tissue product prepared in the respective test "Pressure (KPa)"=cylinder pressure in kPa "Diff. from 0"=difference of the cylinder pressure of the respective test from the cylinder pressure of the reference test in kPa "Temp. 1 (°C.)"=air temperature of the first drying hood in °C.

"Diff. from 0 (°C.)"=difference in temperature of Temp. 1 of the respective test from Temp. 1 of Reference Test no. 0 in °C.

"Temp. 2 (°C.)"=air temperature of the second drying hood in °C., and

"Diff. from 0 (°C.)"=difference of Temp. 2 of the respective test from Temp. 2 of Reference Test 0 in °C.

Further explanations of the above data

The softness of the tissue product is rated in a so-called panel test on the basis of a handkerchief softness scale ranging from 5 to 9. A softness of 5 means a comparatively hard hygienic tissue, whereas a softness of 9 means a very soft tissue.

The two temperatures Temp. 1 and Temp. 2 result from the fact that, in the circumferential direction of the yankee drier, two separate hoods are used for drying the paper web, which extend each by an angle at circumference of approximately 90° along the yankee drier.

TABLE

"Test Results"

| Test | FG | Average MD | Average CD | Increase (toward 0) MD% | Increase (toward 0) CD% | Strength Index | Softness | Press. (KPa) | Diff. from 0 | Temp.1 (°C.) | Diff. from 0 (°C.) | Temp.2 (°C.) | Diff. from 0 (°C.) |
|---|---|---|---|---|---|---|---|---|---|---|---|---|---|
| 0 | 15.92 | 16.97 | 8.5 | — | — | 12.01 | 7.7 | 600 | — | 371 | — | 377 | — |
| 1a | 15.85 | 19.60 | 9.9 | 15 | 17 | 13.93 | 6.4 | 555 | −45 | 292 | −79 | 285 | −92 |
| 1b | 15.88 | 24.53 | 12.2 | 44 | 44 | 17.30 | — | 503 | −97 | 246 | −125 | 282 | −95 |
| 1c | 16.13 | 31.28 | 16.2 | 84 | 90 | 22.51 | 6.1 | 457 | −147 | 230 | −141 | 249 | −128 |
| 2a | 15.63 | 21.14 | 10.74 | 24 | 26 | 15.07 | 7.0 | 652 | +52 | 347 | −24 | 360 | −17 |
| 2b | 15.93 | 26.50 | 11.93 | 56 | 40 | 17.78 | 7.1 | 653 | +53 | 344 | −27 | 357 | −20 |
| 3a | 15.75 | 25.85 | 11.25 | 52 | 32 | 17.05 | 7.4 | 534 | −66 | 298 | −73 | 319 | −58 |
| 3b | 16.07 | 26.27 | 10.37 | 55 | 22 | 16.51 | 7.3 | 506 | −94 | 277 | −94 | 276 | −101 |
| 3c | 16.04 | 27.40 | 11.65 | 61 | 37 | 17.87 | 7.3 | 441 | −159 | 252 | −119 | 275 | −102 |
| 3d | 16.13 | 26.87 | 11.80 | 58 | 39 | 17.81 | 7.4 | 516 | −84 | 331 | −40 | 342 | −35 |
| 4a | 15.95 | 29.33 | 12.30 | 73 | 45 | 18.99 | 7.4 | 553 | −47 | 279 | −92 | 284 | −94 |
| 4b | 16.03 | 25.78 | 11.30 | 52 | 33 | 17.07 | — | 535 | −65 | 273 | −98 | 283 | −94 |
| 4c | 16.13 | 23.8 | 11.10 | 40 | 31 | 17.07 | 7.5 | 528 | −72 | 272 | −99 | 283 | −94 |

What is claimed is:

1. A method for the manufacture of creped hygienic cellulose paper, in particular of tissue paper, comprising the following steps:

producing a cellulose containing pulp, depositing a wet pulp on a continuously rotating wire so as to form a wet pulp web, preliminary drainage of the wet pulp web on the wire, main drainage of the wet pulp web by means of pressing rollers, transferring the wet pulp web to a yankee drier, drying the wet pulp web on the yankee drier, and scraping the dried paper web off the yankee drier while creping the web, wherein, a hemicellulose containing additive which increases strength of the hygienic cellulose paper without simultaneously substantially reducing softness of the hygienic cellulose paper is added to the pulp prior to the deposit of the wet pulp on the wire, after deposit of the wet pulp on the wire, or added both prior to and after the deposit of the wet pulp on the wire.

2. A method according to claim 1, wherein the hemicellulose containing additive is added during the production of the cellulose containing raw material.

3. A method according to claim 2, wherein the hemicellulose containing additive is added directly after the refinement of the cellulose raw material.

4. A method according to claim 2, wherein the hemicellulose containing additive is added to the supply lines supplying the pulp to the wire.

5. A method according to claim 1, wherein a galactomannan solution is added as a hemicellulose containing additive.

6. A method according to claim 5, wherein an approximately 10% solution of galactomannan powder in water with a weight percentage of 0.15% to 1.5% of galactomannan powder related to the dry weight of the cellulose fibers in the pulp is added as a hemicellulose containing additive.

7. A method according to claim 5, wherein a 1% solution of cationic galactomannan powder in water with a weight percentage of 0.15% to 1.5% of galactomannan powder related to the dry weight of the cellulose fibers in the pulp is added as a hemicellulose containing additive.

8. A method according to claim 5, wherein the cationic galactomannan or nonionic galactomannan or a mixture thereof are added as hemicellulose containing additives.

9. A method according to claim 1, wherein birch pulp is added as a hemicellulose containing additive.

10. A method according to claim 9, wherein birch sulfate pulp having a Schopper-Riegler slowness value of at least SR°80 is added as a hemicellulose containing additive.

11. A method according to claim 10, wherein birch pulp of a dry weight percentage of 1 to 6% related to the dry weight of the cellulose fibers in the pulp is added as a hemicellulose containing additive.

12. A method according to claim 1, wherein xylan is added as a hemicellulose containing additive.

13. A method according to claim 12, wherein a 2% solution of xylan in a mixture of sodium hydroxide and water of a pH of 10 to 11 with a dry weight percentage of 0.15% to 1.5% of xylan related to the dry weight of the cellulose fibers in the pulp is added as a hemicellulose containing additive.

14. A method according to claim 1, wherein the pH of the pulp is set to a range of 8.0 to 8.5, in that subsequently the hemicellulose containing additive is added and mixed with the pulp preferably by stirring and in that finally the pH of the mix is set to 6.5 to 7.0.

15. A method according to claim 1, wherein a cationic fixative and a wet strength agent are added to the pulp.

* * * * *